United States Patent [19]

Vanover, Sr.

[11] Patent Number: 4,549,342

[45] Date of Patent: Oct. 29, 1985

[54] BELT BUCKLE MACHINE

[76] Inventor: Bob Vanover, Sr., 5000 Redwood Dr. North, Ft. Worth, Tex. 76119

[21] Appl. No.: 623,844

[22] Filed: Jun. 22, 1984

[51] Int. Cl.[4] ..... B21D 53/46

[52] U.S. Cl. ..... 29/3

[58] Field of Search ..... 29/3, 464, 465, 466, 29/505, 509, 795, 796, 243.5

[56] References Cited

U.S. PATENT DOCUMENTS

| | | | |
|---|---|---|---|
| 1,957,842 | 5/1934 | McDonough | 29/3 |
| 2,254,077 | 8/1941 | Levin et al. | 29/3 |
| 2,841,859 | 7/1958 | Spendal | 29/3 |
| 3,087,227 | 4/1963 | Lerma | 29/3 |
| 3,167,849 | 2/1965 | Eisenpresser et al. | 29/3 |
| 3,430,315 | 3/1969 | Mitsui | 29/3 |

*Primary Examiner*—Howard N. Goldberg
*Assistant Examiner*—Steven Nichols
*Attorney, Agent, or Firm*—James E. Bradley

[57] ABSTRACT

A semi-automated machine for use with Spendel type belt buckle dies which are mounted on a horizontally reciprocable table to position selectively either an outer or an inner buckle piece die beneath an upper die, which is adapted with a core and a pressure frame controlled by a pressure cylinder called a shot cylinder and a pin that entends into an annular ring and a mandrel. The upper die receives initially an outer buckle piece member and it decorative covering, retains them and then forcibly urges them against an inner buckle piece member to form a decorative buckle that need not rely on adhesives. A power cylinder urges the upper die downward, while another called a slide cylinder, reciprocates a table on which the lower dies are secured. An operator guard is reciprocably retained on the table support to move oppositely from the table to force the operator's hands and arms away from the danger of the engaging dies, being powered for such movement by a fluid cylinder. A fluid circuit controls the various components in a semi-automated fashion to enhance efficiency.

3 Claims, 8 Drawing Figures

BELT BUCKLE MACHINE

BACKGROUND

1. Field of the Invention

This invention relates to those methods and machines used to manufacture articles such as belt buckles, especially to those using multiple dies that provide a decorative covering over inner and outer rigid members such as buckle pieces.

2. Background Information

Previously, decorative belt buckles have been manufactured, consisting of two separate buckle frame pieces, normally stamped from sheet iron, one an inner piece and the other an outer piece with their edges bent to cooperatively engage. The upper piece is usually covered, without the use of an adhesive, of a compatible material with the clothes with which the buckle will be worn. A patch of the material is clamped between the edges of the inner and outer buckle pieces by the use of a set of special dies.

Commercially successful dies are disclosed in U.S. Pat. No. 2,841,859 to Kurt Spendel, "Device for Mounting of Covered Buckles", July 8, 1958. Spendel uses a pair of dies which will be referred to a "lower dies", one to receive the outer buckle piece and the other to recieve the inner buckle piece. A pliable covering is placed over the outer buckle piece in the first of the lower dies and this combination urged into a mating cavity in the upper die. Then the inner buckle piece is placed in the second lower die, the edges of which are urged into a mating and clamping relationship with the outer buckle member and the decorative covering. Each of the dies has a main frame, a core piece and a pressure frame such that pressure against the core results in pressure against the pressure frames that engage the buckle pieces and the material in a sequential relationship to form the buckle. A review of the Spendel patent is helpful in forming a more comprehensive understanding of the dies and their sequence of operation, since variations of these dies are referred to in the description of the preferred embodiment.

SUMMARY OF THE INVENTION

It is the general object of the invention to provide semi-automated machinery which uses Spendel type dies in a more efficent and cost effective manner.

This object is accomplished in general by the provision of a table mounted on a frame for powered and horizontally reciprocating motion of a pair of laterally spaced lower dies, one being the outer and the other being the inner buckle piece die. Each of these dies contains a core piece and a pressure frame to selectively engage the buckle pieces and decorative covering to form a buckle. An upper die is mounted on the frame for powered reciprocating vertical movement selectively against either the inner or outer member die, and includes a core and a two position pressure frame.

An upper position of the core of the upper die cooperates with the outer member die and a lower position cooperates with the inner member die. The core is engaged by a mandrel which extends through an annular ring or donut, and a powered pin extends through the die, the core and the mandrel to control the positions of the pressure frame in the upper die. The positions of the pressure frames in the lower dies is controlled by spring mounting the dies as taught by Spendel.

Operator safety is enhanced by mounting a vertical operator guard reciprocably on the table to move preferably in an opposite direction from the table during movement of the lower dies alternately under the upper die.

Power cylinders of preferably the pneumatic type are used to reciprocate the table, the upper die, the pin in the upper die and the operator guard. Further, a fluid circuit having limit controls is utilized to provide the desired degree of automated or semi-automated utilization of the machine and its components.

The above as well as additional objects, features and advantages of the invention will become apparent in the following description.

DESCRIPTION OF THE PREFERRED EMBODIMENT

Figure 1:
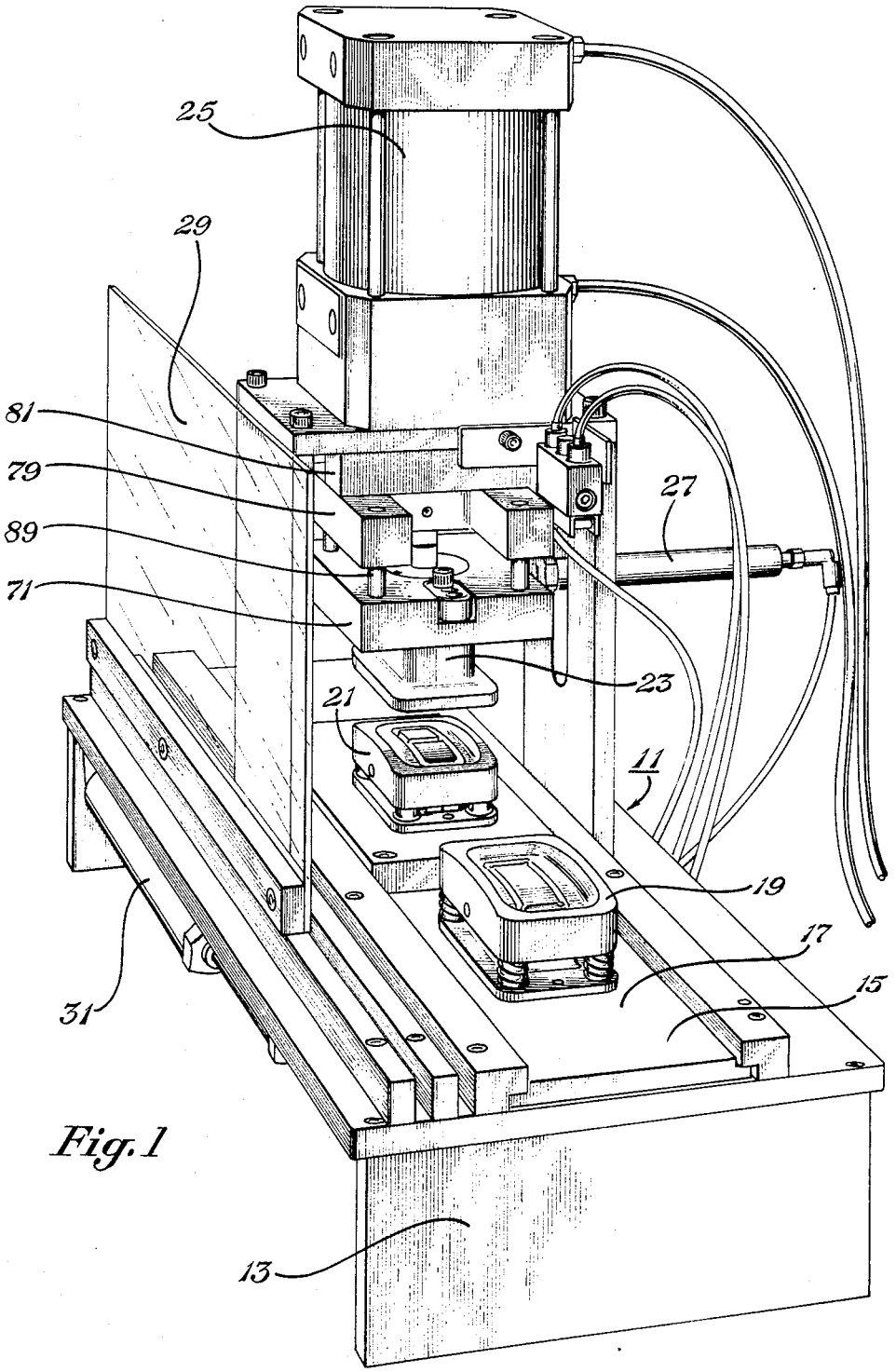
FIG. 1 is a perspective view of a semi-automated machine for the manufacture of belt buckles having a decorative covering form with dies having a construction and operated in accordance with the principles of my invention.

With reference to FIG. 1 of the drawings, the numeral 11 represents the frame of a machine supported on legs 13 to include a table support 15 and a reciprocating table 17 containing a pair of spaced dies, one being an outer buckle piece die 19 and the other being an inner buckle piece die 21. An upper die 23 is carried by the frame 11 and is operated by a power cylinder 25 and a shot cylinder 27 in a manner to be more fully described subsequently. A vertical operator guide 29 is secured to the table support 15 to move oppositely to the direction of the reciprocating table 17, being powered by a power cylinder 31.

Figure 2:
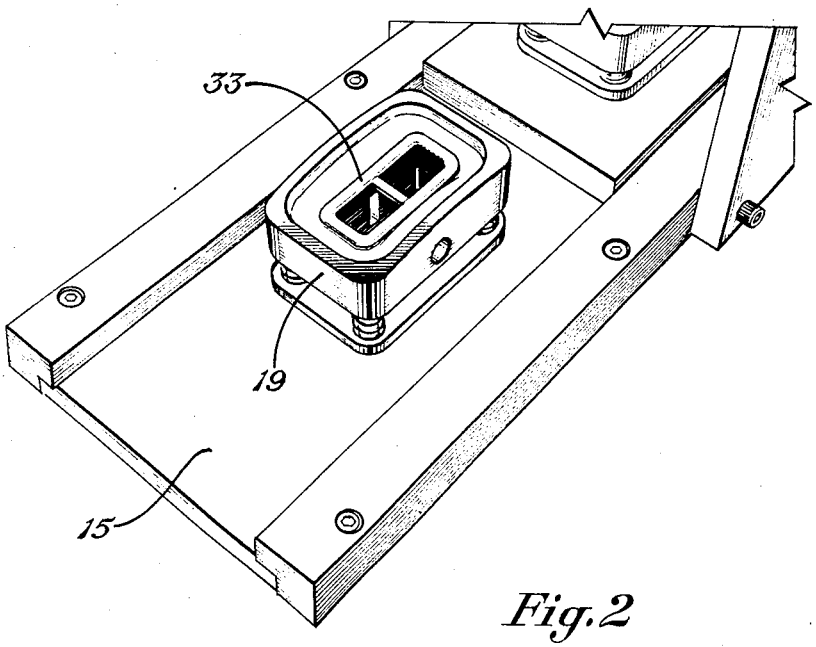
FIG. 2 is a perspective view of a portion of the machine of FIG. 1, showing especially the outer buckle piece die with the outer buckle piece positioned therein.
Figure 3:
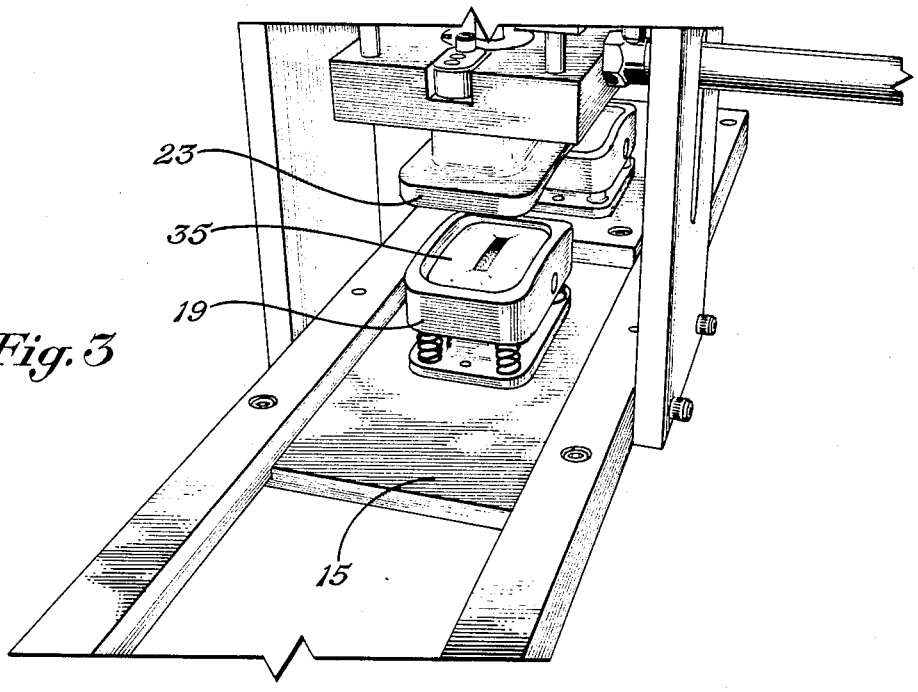
FIG. 3 is a perspective view of the outer buckle piece die with a decorative and pliable covering therein, with the table reciprocated into position under the upper die.
Figure 4:
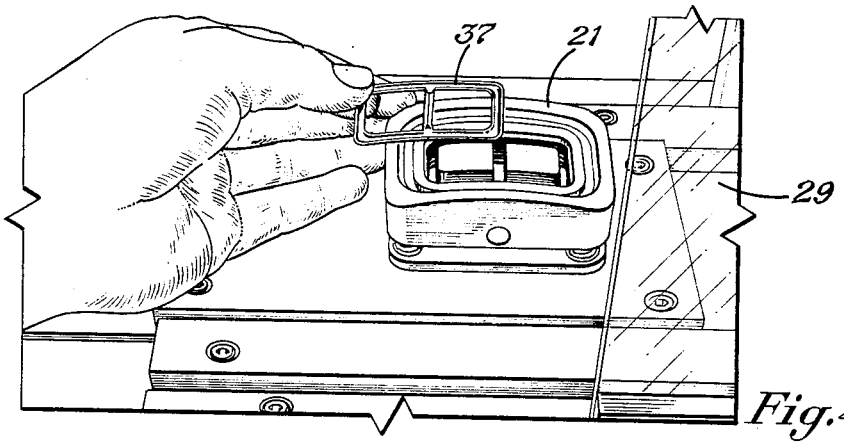
FIG. 4 is a perspective view of the inner buckle piece die and an inner buckle piece being placed in position.
Figure 5:
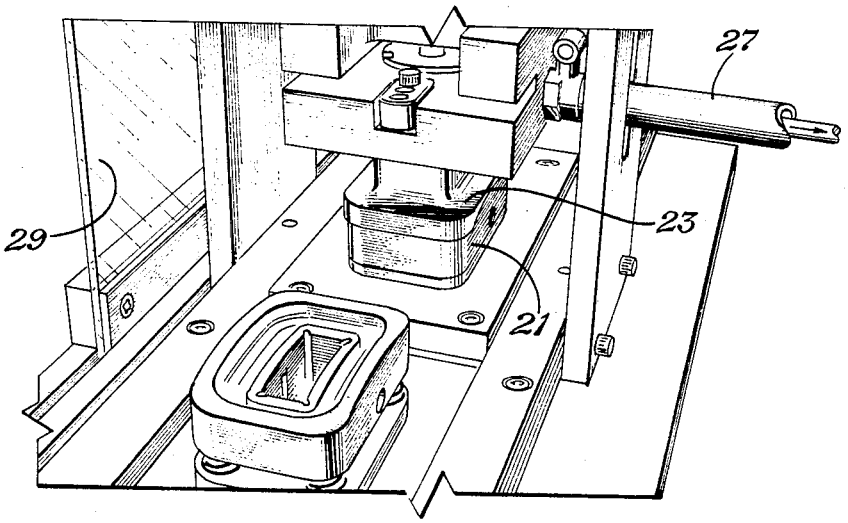
FIG. 5 is a perspective view, seen from the back of the machine, of the upper die being urged against the lower, inner buckle piece die to join the inner and outer buckle pieces and the pliable covering.
Figure 6:
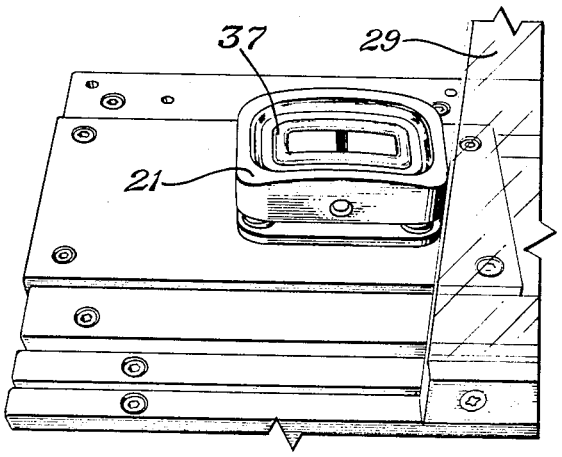
FIG. 6 is a perspective view of the lower and inner buckle piece die after the upper die has completed the engagement and connection of the inner and outer buckle pieces with the pliable and decorative covering.

To facilitate a more detailed understanding of the machine, its various components and their operation, an overview of the basic steps used in the manufacture of a belt buckle should be helpful. FIG. 2 illustrated primarily the lower, outer buckle piece die 19 with an outer buckle piece 33 positioned therein. In FIG. 3 the reciprocating table 17 has moved the outer buckle piece die 19 underneath the upper die 23 into the stamping position, after a patch of pliable and decorative covering 35 has been positioned over the outer buckle piece 33. At this time the upper die stamps downwardly onto the lower, outer piece die 19 to compress and confine the outer buckle piece 33 and decorative covering 35. During this cycle, the pin 75 (see FIG. 7) is forced into the mandrel 61. An inner buckle piece 36 is shown in FIG. 4 being positioned in a cavity in the inner buckle piece die 21, which thereafter is moved by the reciprocating table 17 underneath the upper die 23 for stamping, as indicated in FIG. 5. Although not visible in FIG. 5, the shot cylinder 27 is actuated at this time to remove pin 75 from mandrel 61 to allow a pressure frame of the type disclosed by Spendel to move downwardly relative to the upper die 23 so that a solid impact against the buckle assures effective clamping of the decorative covering 35 between the outer and inner buckle pieces 33, 36. Then the upper die 23 is moved upwardly to expose the finished buckle 37 for removal from the inner buckle piece die 21, as indicated in FIG. 6.

Figure 7:
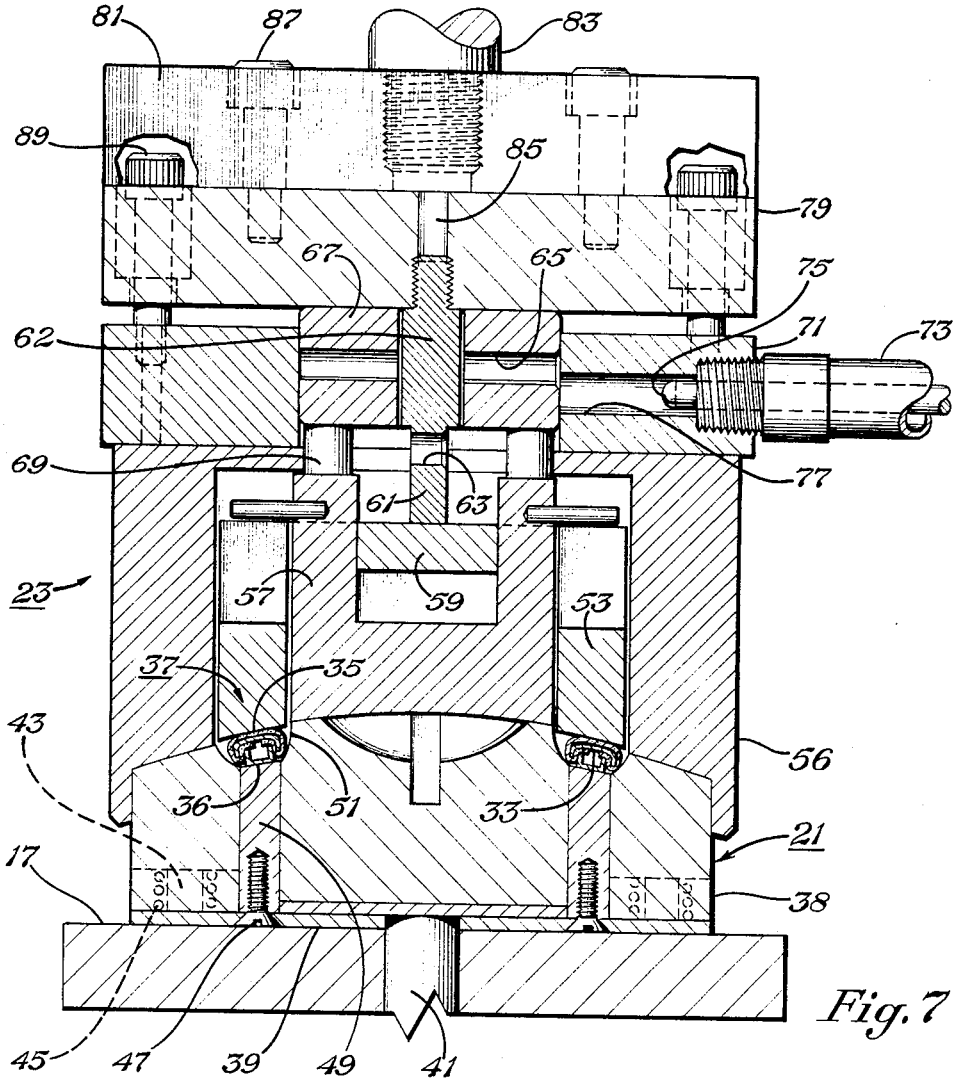
FIG. 7 is a sectional view of the upper die in engagement with the lower, inner buckle piece die, with the pressure cylinder and shot cylinder also shown to indicate the structure of the mandrel, the annular ring and the pin used to establish alternate positions of the core and the pressure frame of the die.

The sectional view of FIG. 7 illustrates the interior construction of one of the lower dies, here the inner buckle piece die 21, the upper die 23 and other components that are used in the maachine to achieve the above described sequence of manufacturing operations. The outer frame 38 of the lower die 21 is secured to the reciprocating table 17 by use of a base plate 39 and positioning posts 41, and is free to move upwardly or downwardly a predetermined distance on support posts 43, being biased upwardly by the coil springs 45. A plurality of fasteners 47 hold counter supports 49 in a stationary position relative to the table 17 in the same manner as taught by Spendel to define a variable volume cavity 51 to receive initially the inner buckle piece 36 and subsequently the outer buckle piece 33 and the decorative covering 35.

In FIG. 7 the upper die 23 is shown in the stamping position in which the finished buckle 37 is being formed by the downward movement of the pressure frame 53 which reciprocates relative to the core piece 57 and also relative to frame 56 of upper die 23. The pressure frame 53 has a cross-member 59 supported on the upper end. The lower end of a mandrel 61 contacts the cross-member 59 to move the pressure frame 53 downwardly. Mandrel 61 has a midregion 62, below which is an aperture 63 adapted to be aligned with a drilled aperture 65 in an annular ring or adapter member 67 supported above the core piece 57 in a movable position on the columns 69. A shot cylinder mounting plate 71 receives a mounting tube 73 of a shot cylinder 27 (see FIG. 1) to selectively actuate a pin 75 through an opening 77 in the plate 71 to extend into or retract from the apertures 65, 63. The mounting plate 71 is slidingly secured to mounting bracket 79, which in turn is secured to the frame 11 of the machine. A flange 81 above the mounting bracket 79 receives the end of an actuator 83 which moves flange 81 and mounting bracket 79 up and down by means of the hydraulic cylinder 25. Hole 85 and mounting bracket 79 is threaded to receive the threaded upper end of mandrel 61. The flange 81 is secured to the mounting bracket 79 by suitable fasteners 87, while the mounting bracket 77 is secured to the mounting plate 71 by suitable fasteners 89.

Figure 8:
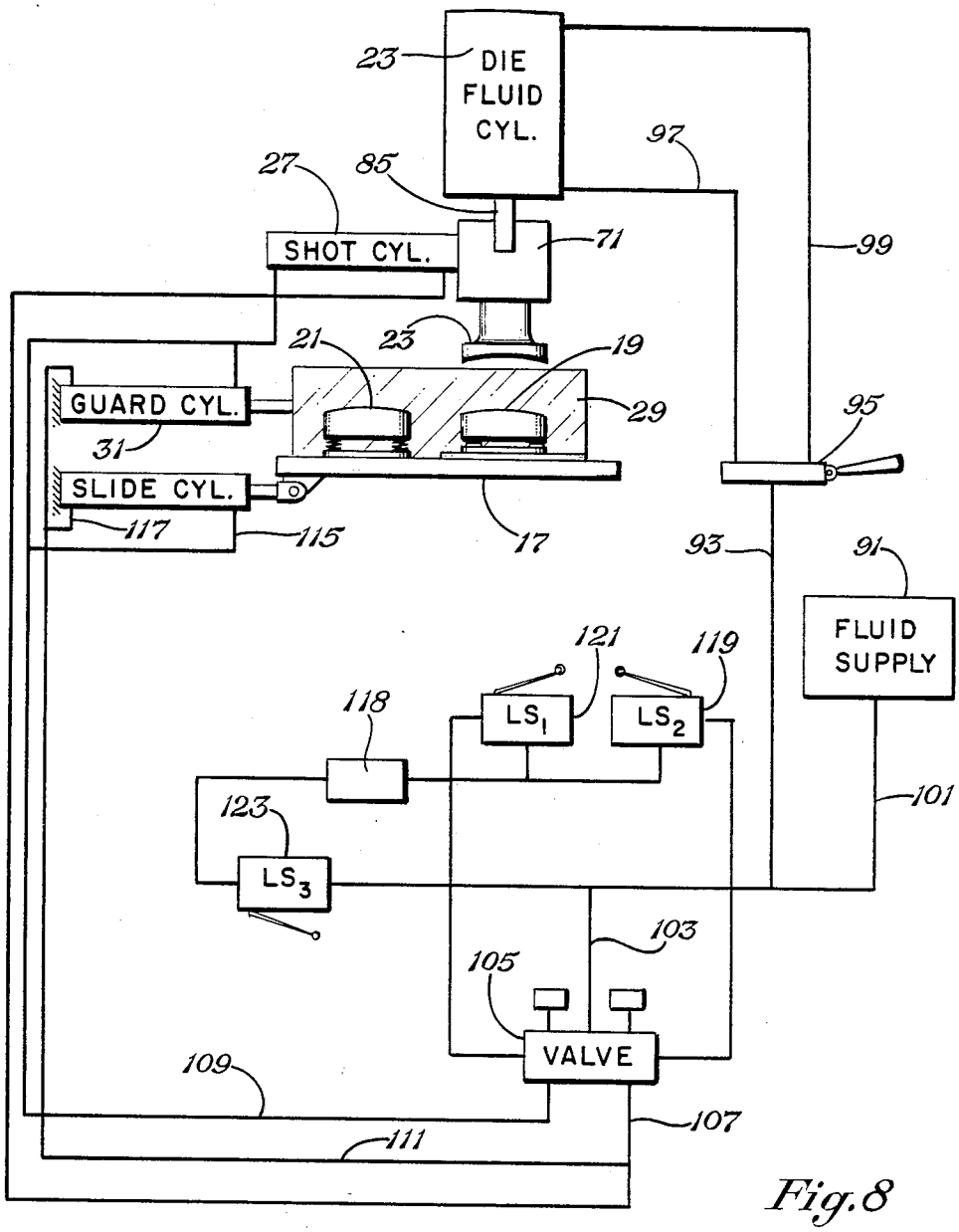
FIG. 8 is a schematic diagram showing the preferred circuit used to operate the components of the machine.

The sequential operation of the above described components are controlled by a pneumatic circuit illustrated in FIG. 8. A source of pressurized air or gas is indicated by the fluid supply 91 in FIG. 8, which supplies through a line 93 a preferably foot operated valve 95 which directs fluid selectively into or from a pair of lines 97, 99 connected to the power cylinder 25 that operates the actuator 85 (see FIG. 7) to reciprocate those previously described components associated with the upper die 23. A line 101 connects through branch 103 with a valve 105, which controls through lines 107, 109 fluid flow to and from the shot cylinder 27 connected to the mounting plate 71 above the upper die 23. A branch 111 from line 107 and a branch 113 from line 109 are used to direct fluid from the valve 105 to the guard cylinder 31 used to reciprocate the guard 29. Branches 115, 117 extending from those designated respectively 109, 111 control fluid flow to and from the slide cylinder 31 used to reciprocate the reciprocable table 17 which supports the lower dies 19, 21. Limit switches 119, 121, 123 are used in the circuit to control the travel of the power cylinder to enhance safety and reliability of operation. A pulse generator 118 is inserted in the line between limit switches 121 and 123 to actuate and alternate the valve 95 in response to changes in one or another of the limit switches.

It should be apparent from the foregoing description that I have provided an invention having significant advantages. The use of a reciprocating table upon which is mounted a pair of lower dies, one to initially receive the outer buckle piece member and it's pliable, decorative covering and the other to receive the inner buckle piece member adds significantly to efficiency of operation in that manual operation of the dies, as disclosed by Spendel, is eliminated, especially when used with a powered upper die and the powered shot cylinder that control the positions of the interior component of the upper die. Thus the powered movements of the upper die selectively against either of the lower dies effectively provides a finished belt buckle that firmly confines a decorative covering over an outer buckle piece member with cooperation from an inner buckle piece menber. The use of a powered pin to extend through an annular ring and a mandrel to position the core piece as well as the pressure frame of the upper die is instrumental in achieving the objects of the invention. Further, the use of a powered operator guard that moves oppositely from the reciprocable table enhances safety of operation.

While the invention has been shown in only its preferred form, it should be apparent to those skilled in the art that it is not thus limited but is susceptible to various changes and modifications without departing from the spirit thereof.

I claim:

1. An improved machine for forming a belt buckle which has outer and inner buckle pieces that cooperatively hold a pliable and decorative covering over the outer piece, the machine comprising in combination:

a frame;

a table mounted on the frame for powered reciprocating horizontal movement;

a pair of laterally spaced lower dies on the reciprocating table, one being the outer buckle piece die and the other being the inner buckle piece die, each die having a core piece and forming frame to selectively engage the buckle pieces and decorative covering to form a buckle;

an upper die mounted on the frame for powered reciprocating vertical movement selectively against both the inner buckle piece die and the outer buckle piece die;

the upper die having an outer frame which contains therein a core and a pressure frame located in an annular cavity between the core and the outer frame;

the pressure frame being reciprocable between an upper position and a lower position relative to the core and outer frame, so that an outer buckle piece and protective covering placed on the outer buckle piece die will enter the cavity and press against the pressure frame when in the upper position, and so that the outer buckle piece and protective covering will be pressed by the pressure frame out of the cavity against an inner buckle piece located on the inner buckle piece die when the pressure frame moves to the lower position;

the core being movable between a lower position relative to the outer frame which occurs while the pressure frame is moving to the upper position and an upper position which occurs while the pressure frame is moving to the lower position;

a mandrel movable between upper and lower positions and adapted to engage the pressure frame for moving the pressure frame to the lower position, the mandrel having a transverse hole;

an adapter member located above the core and through which reciprocally extends the mandrel, the adapter member having a transverse hole;

for reciprocable pin means mounted to the outer frame of the upper die for movement between an inner position located in the holes to lock the core in the lower position and the mandrel in the upper position, and an outer position retracted from the holes to allow movement of the core and mandrel relative to each other and to the outer frame; and means for moving the mandrel between the upper and lower positions.

2. An improved machine for forming a belt buckle which has outer and inner buckle pieces that cooperatively hold a pliable and decorative covering over the outer piece, the machine comprising in combination:

a frame;

a table mounted on the frame for powered reciprocating horizontal movement;

a pair of laterally spaced lower dies on the reciprocating table, one being an outer buckle piece die and the other being the inner buckle piece die, each die having a core piece and a forming frame to selectively engage the buckle pieces and decorative covering to form a buckle;

an upper die mounted on the frame for powered reciprocating vertical movement selectively against both the inner buckle piece die and the outer buckle piece die;

the upper die having an outer frame which contains therein a core and a pressure frame located in an annular cavity between the core and the outer frame;

the pressure frame being reciprocable between an upper position and a lower position relative to the core and outer frame, so that an outer buckle piece and protective covering placed on the outer buckle piece die will enter the cavity and press against the pressure frame when in the upper position, and so that the outer buckle piece and protective covering will be pressed by the pressure frame out of the cavity against an inner buckle piece located on the inner buckle piece die which the pressure frame moves to the lower position;

the core being movable between a lower position relative to the outer frame which occurs while the pressure frame is moving to the upper position and an upper position which occurs while the pressure frame is moving to the lower position;

a mandrel movable between upper and lower positions and adapted to engage the pressure frame for moving the pressure frame to the lower position, the mandrel having a transverse hole;

an adapter member located above the core and through which reciprocally extends the mandrel, the adapter member having a transverse hole adapted to align with the transverse hole in the mandrel when the core is in the lower position and the mandrel in the upper position;

reciprocable pin means mounted to the outer frame of the upper die for movement between an inner position located in the aligned holes to lock the core in the lower position and the mandrel in the upper position, and an outer position retracted from the holes to allow movement of the core and mandrel relative to each other and to the outer frame; and means for moving the mandrel between the upper and lower positions.

3. An improved machine for forming a belt buckle which has outer and inner buckle pieces that cooperatively hold a pliable and decorative covering over the outer piece, the machine comprising in combination:

a frame;

a table mounted on the frame for powered reciprocating horizontal movement;

a slide fluid cylinder mounted to the frame and to the table to move the table between two lateral positions;

a pair of laterally spaced lower dies on the reciprocating table, one being the outer buckle piece die and the other being the inner buckle piece die, each die having a core piece and a forming frame to selectively engage the buckle pieces and decorative covering to form a buckle;

an upper die mounted on the frame for powered reciprocal vertical movement selectively against both the inner buckle piece die and the outer buckle piece die, dependent upon the position of the table determined by the slide cylinder;

a die fluid cylinder mounted to the frame and a mounting plate above the die for selective activation to move the mounting plate to urge the upper die against the lower dies depending upon the position of the table;

the upper die having an outer frame which contains therein a core and a pressure frame located in an annular cavity between the core and the outer frame;

the pressure frame being reciprocable between an upper position and a lower position relative to the core and outer frame, so that an outer buckle piece and protective covering placed on the outer buckle piece die will enter the cavity and press against the pressure frame when in the upper position, and so that the outer buckle piece and protective covering will be pressed by the pressure frame out of the cavity against an inner buckle piece located on the inner buckle piece die when the pressure frame moves to the lower position;

the core being movable between a lower position relative to the outer frame which occurs while the pressure frame is moving to the upper position and an upper position which occurs while the pressure frame is moving to the lower position;

a mandrel extending axially upward from the pressure frame and connected to the mounting plate, the mandrel being movable between upper and lower positions and adapted to engage the pressure frame for moving the pressure frame to the lower position, the mandrel having a transverse hole;

an adapter member located above the core and through which reciprocally extends the mandrel, the adapter member having a transverse hole adapted to align with the transverse hole in the mandrel when the core is in the lower position and the mandrel in the upper position;

a reciprocable pin mounted to the outer frame of the upper die for movement between an inner position located in the aligned holes to lock the core in the lower position and the mandrel in the upper position, and an outer position retracted from the holes to allow movement of the core and mandrel relative to each other and to the outer frame;

power means for moving the pin between the inner and outer positions; and means for moving the mandrel between the upper and lower positions.

* * * * *